United States Patent [19]

Kohler et al.

[11] Patent Number: 4,469,043

[45] Date of Patent: Sep. 4, 1984

[54] CLEANING MECHANISM FOR COATING CONTROL FLUID NOZZLE

[75] Inventors: Herbert B. Kohler, Greentown; John B. Kohler; Gordon A. E. Kohler, both of North Canton, all of Ohio

[73] Assignee: The Kohler Coating Machinery Corporation, Greentown, Ohio

[21] Appl. No.: 447,636

[22] Filed: Dec. 7, 1982

[51] Int. Cl.[3] ..... B05B 15/02

[52] U.S. Cl. ..... 118/63; 15/21 R; 15/93 R; 118/302

[58] Field of Search ..... 15/21 R, 21 E, 4, 53 R, 15/53 A, 53 B, 93 R, 93 A, 97 R, 104.07, 104.1 C, 56, 405; 118/21, 63, 302; 239/115, 123

[56] References Cited

U.S. PATENT DOCUMENTS

| | | | |
|---|---|---|---|
| 3,120,668 | 2/1964 | Cook et al. | 15/21 R |
| 3,458,396 | 7/1969 | Grant | 15/93 R X |
| 3,471,888 | 10/1969 | Grant et al. | 15/104.1 C X |
| 3,479,678 | 11/1969 | Jeffreys | 15/21 E |
| 3,817,348 | 6/1974 | Jones | 15/56 |
| 3,937,162 | 2/1976 | Fukutani | 15/93 R X |
| 4,181,094 | 1/1980 | Gardiner | 118/63 |
| 4,279,052 | 7/1981 | Evrard et al. | 15/56 |

*Primary Examiner*—Edward L. Roberts
*Attorney, Agent, or Firm*—Oldham, Oldham, Hudak, Weber & Sand Co.

[57] ABSTRACT

A mechanism for cleaning the discharge opening lips of a coating control nozzle by controlled movement of a plurality of brushes transversely along the nozzle lips. A carriage is mounted on a support frame and is moved along the frame by a rodless cylinder. A plurality of brushes rotated by air motors are mounted on the carriage and are moved along the nozzle lips for cleaning by the carriage. The brushes are mounted on one end of a bellcrank which is attached to the carriage and are pivotally moved into and out of engagement with the nozzle lips by a fluid actuated cylinder mounted on the carriage. One of the brushes engages and cleans the inside surfaces of both nozzle lips simultaneously with two pairs of brushes which clean the outside surfaces of both lips as the carriage moves the brushes transversely along the nozzle opening. A stop is engaged by the bellcrank to limit the pivotal movement of the bellcrank to position the brushes with respect to the nozzle lips. The brushes may be replaced with scraper blades mounted on the end of the bellcrank.

14 Claims, 11 Drawing Figures

CLEANING MECHANISM FOR COATING CONTROL FLUID NOZZLE

BACKGROUND OF THE INVENTION

1. Field of the Invention

The invention relates to improvements in cleaning mechanisms for coating machines and the like. More particularly, the invention relates to a cleaning mechanism for mechanically cleaning the nozzle lips of the discharge opening of a fluid nozzle used primarily in the coating industry.

2. Description of the Prior Art

Gaseous fluid nozzles have been used in the coating industry for at least two basic functions, the first of which may be classified as "doctoring means," wherein the nozzle jet of fluid, usually gaseous fluid such as air, acts directly on a liquid or semi-liquid material which has been applied as a coating to the surface of a substrate, such as paper, film, foil, cloth or metal strip, in excess immediately ahead of or upstream from the particular nozzle in terms of movement of the substrate relative to the nozzle to reduce the coating to the desired thickness and smoothness.

Another basic use of gaseous fluid nozzles in the strip processing industry is as a "backing means", in which case, the air or other gaseous fluid jet is applied to one side of the moving strip, such as paper or plastic film, to maintain a uniform pressure against an object on the opposite side, such as a cooling roll or a rigid coating knife. One example of this "backing means" use is illustrated in U.S. Pat. No. 3,113,884.

It is not intended to limit the principles of the present invention to the paper coating industry or the coating of substrates of this general type, but rather it is fully contemplated that the principles of the present invention may be applied to nozzles for many uses, some of which may not be presently known.

It is extremely important in the coating industry that downtime and scrap be kept to a minimum. Since the coating station is usually only one part of a complicated expensive machine with a high rate of production, such as a paper board machine, or a steel galvanizing line, faults such as dirt in the nozzle produce scrap rapidly while stops disrupt many processes and restarting may take many minutes. Since a speck of dirt on or in the nozzle can cause a streak in a 200 inch wide strip running 1000 feet per minute or more, lost time and lost production cannot be tolerated.

These problems have long been recognized and U.S. Pat. Nos. 2,766,720 and 2,981,223 were offered to allow one nozzle subassembly to be quickly substituted for another. However, although these and variations thereon worked, it proved difficult, expensive and time consuming defeating the intended purpose.

Thus, the need has exited for an improved mechanism for efficiently cleaning coating control fluid nozzles in an extremely short period of time to reduce the amount of nozzle downtime. We know of no cleaning mechanism which accomplishes this result in a manner as efficient as our improved cleaning mechanism described in detail below.

SUMMARY OF THE INVENTION

Objectives of the invention include providing a cleaning mechanism for coating control fluid nozzles in which the nozzle preferably is an opening style nozzle formed by two body halves terminating in nozzle lips, the spacing of which forms the nozzle discharge opening, in which the cleaning mechanism will reduce the downtime required for cleaning the nozzle lips, and in which the cleaning mechanism will provide a positive cleaning action on the nozzle lips by power driven brushes or scraper blades which engage both the inside and outside surfaces of the nozzle lips for efficiently and effectively cleaning the same.

Another objective of the invention is to provide such an improved cleaning mechanism in which the power driven brushes or scraper blades can be brought into cleaning engagement with the nozzle lips at any location along the lips and moved in a back and forth motion over a predetermined problem area of the lips thereby cleaning only the problem area reducing the amount of downtime required for correcting a streaking problem in a coated strip. Likewise, the cleaning brushes or scraper blades can be moved along the entire length of the nozzle lips if desired instead of a specific area.

Another objective of the invention is to provide such a cleaning mechanism in which the cleaning brushes or blades are movable to a predetermined position for engagement with the nozzle lips by a simple bellcrank mechanism controlled by a fluid cylinder, and in which an adjustable stop engages the bellcrank to limit the swinging movement of the bellcrank to the proper engagement position with the nozzle lips. A still further objective is to provide such a cleaning mechanism in which the bellcrank on which the cleaning brushes or blades are mounted is pivotally mounted on a carriage, in which the carriage is mounted on slide bushings and is moved transversely along the nozzle lips by a rodless cylinder which provides a relatively simple and compact structure, and in which the rodless cylinder can be controlled pneumatically from a main control station by an operator or may be actuated automatically upon movement of the nozzle to a predetermined position.

Still another objective of the invention is to provide such an improved cleaning mechanism in which the cleaning brushes are arranged whereby at least one brush projects into the nozzle opening to clean the inside of the nozzle lips with additional pairs of brushes engageable with the outside surface of the nozzle lips to clean the same, and in which the individual brushes of each nozzle pair rotate in opposite directions to provide an efficient cleaning action on the lips to loosen and remove all foreign dirt and materials therefrom. Furthermore, the scraper blades can be formed of a low friction plastic material which will slide easily along the nozzle lips without scratching and can be used alone or in combination with the brushes.

A further objective of the invention is to provide such an improved cleaning mechanism which eliminates difficulties heretofore encountered, eliminates time consuming manual cleaning of the nozzle lips, achieves the stated objectives simply and efficiently, and solves problems and satisfies needs existing in the art.

These objectives and advantages are obtained by the improved cleaning mechanism for coating control fluid nozzles, a general nature of which may be stated as including a frame adapted to be located adjacent a nozzle to be cleaned; carriage means mounted on the frame for transverse movement along and generally throughout the length of the discharge opening of a nozzle; carriage drive means for moving the carriage means along the frame; cleaning means mounted on the carriage means for engagement with the nozzle lips; and means for moving the cleaning means into and out of engagement with the nozzle lips whereby the cleaning means will clean the nozzle lips as the carriage means is moved transversely along the nozzle lips.

BRIEF DESCRIPTION OF THE DRAWINGS

A preferred embodiment of the invention, illustrative of the best mode in which applicants have contemplated applying the principles, is set forth in the following description and shown in the drawings and is particularly and distinctly pointed out and set forth in the appended claims.

Similar numerals refer to similar parts throughout the drawings.

DESCRIPTION OF THE PREFERRED EMBODIMENT

Figures 1, 6:
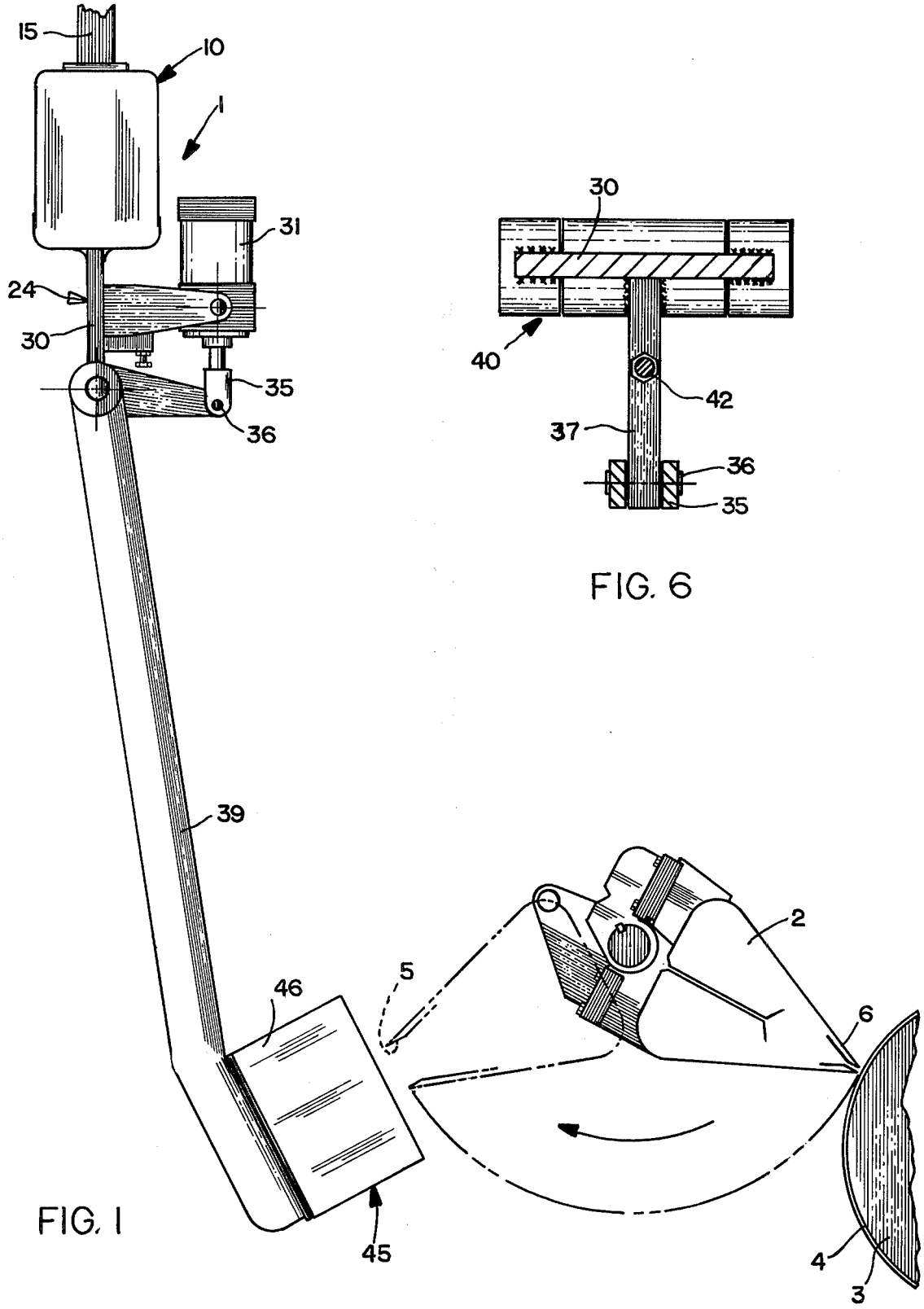
FIG. 1 is a fragmentary side elevational view of the improved cleaning mechanism shown in retracted position adjacent a coating control nozzle which is shown in full lines in operative position controlling a coating on a moving substrate.
FIG. 6 is a fragmentary sectional view taken on line 6—6, FIG. 2.

The improved nozzle cleaning mechanism is indicated generally at 1, and is shown in FIG. 1 in a retracted position adjacent a coating control nozzle 2. Nozzle 2 is shown in full lines in operating position adjacent a backup roll 3 for controlling a coating applied to a substrate 4 which moves around backup roll 3. Nozzle 2 is shown in FIG. 1 in dot dash lines in a position for cleaning by improved mechanism 1. Nozzle 2 preferably is an opening-style nozzle of the type shown in U.S. Pat. No. 3,314,163 and is adapted to be mounted on various types of mounting frames and supports which enable the nozzle to be pivotally moved from the full line position of FIG. 1 to the dot dash position for cleaning of a nozzle discharge opening 5 formed by a pair of spaced nozzle lips 6. The particular type and construction of frame for mounting nozzle 2 adjacent a moving substrate may vary and forms no particular part of the present invention. Likewise, although nozzle 2 is described as an opening-style nozzle, the nozzle lips could be fixed and still be cleaned satisfactorily by improved nozzle cleaning mechanism 1.

Figure 2:
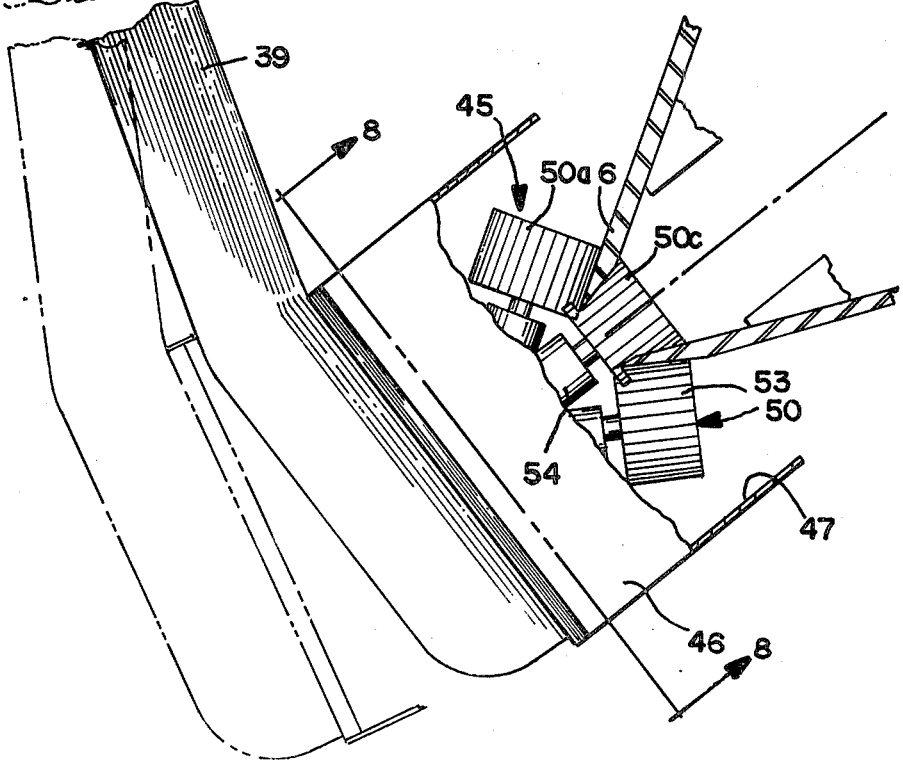
FIG. 2 is an enlarged side elevational view with portions broken away and in section, showing the improved nozzle cleaning mechanism cleaning the lips of a nozzle discharge opening.
Figure 4:
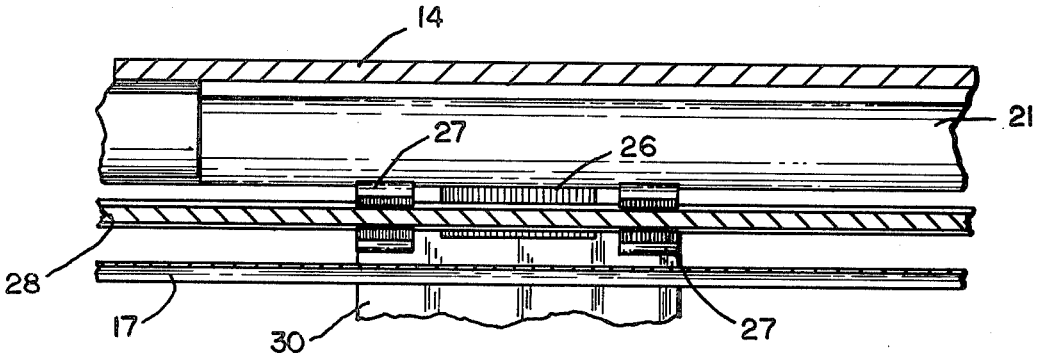
FIG. 4 is an enlarged fragmentary sectional view taken on line 4—4, FIG. 2.
Figure 5:
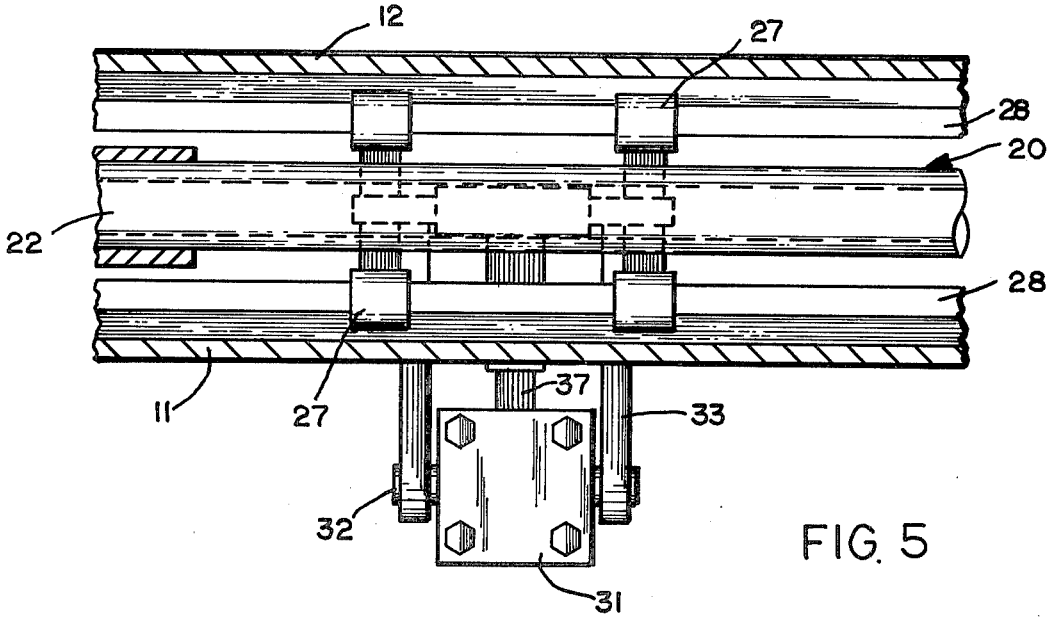
FIG. 5 is an enlarged fragmentary sectional view taken on line 5—5, FIG. 2.
Figure 7:
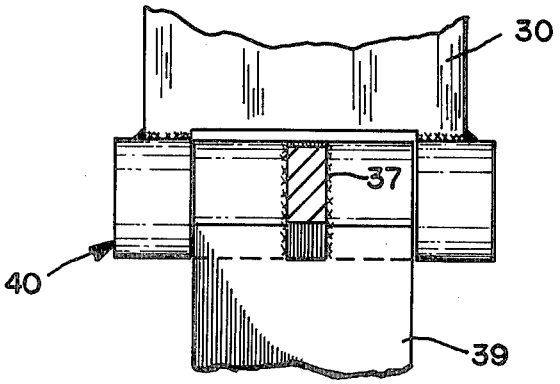
FIG. 7 is a fragmentary sectional view taken on line 7—7, FIG. 2.

The improving cleaning mechanism is shown particularly in FIG. 2 and includes a fixed frame indicated generally at 10. Frame 10 is shown as being formed by a pair of side walls 11 and 12, a top wall 13 and an intermediate horizontally extending wall 14. Frame 10 is adapted to be supported from an overhead structure by a supporting beam 15. The lower end of side walls 11 and 12 together with intermediate wall 14 form a chamber 16 that is closed at the bottom by a sheet metal cover 17 formed with a central transversely extending slot 18.

In accordance with one of the features of the invention, a rodless, linear drive cylinder indicated generally at 20, is mounted on intermediate wall 14 and located within chamber 16. Rodless cylinder 20 includes a yoke 21 or cylinder barrel and a movable piston 22. Cylinder 20 preferably is pneumatically operated and may be of the type distributed by Origa Corporation of Elmhurst, Ill. or by Festo Corporation of Hauppauge, N.Y. Likewise, rodless cylinder 20 may be of the type having a direct coupling or a magnetic coupling arrangement since the particular construction of the rodless cylinder and means of connection do not affect the concept of the present invention. Rodless cylinder 20 provides a convenient means for supplying the movement and motive force to a carriage which is indicated generally at 24 which is operatively connected to rodless cylinder 20 and moved transversely along frame 10 by the cylinder piston 22.

Carriage 24 includes a horizontal plate 25 which is connected to piston 22 by a coupler plate 26. A pair of slide bushings 27 are mounted on the ends of horizontal plate 25 and are slidably engaged and supported by a pair of slide rails 28. Rails 28 are attached to the bottom of frame walls 11 and 12 and extend horizontally inwardly as shown in FIG. 2.

Figure 3:
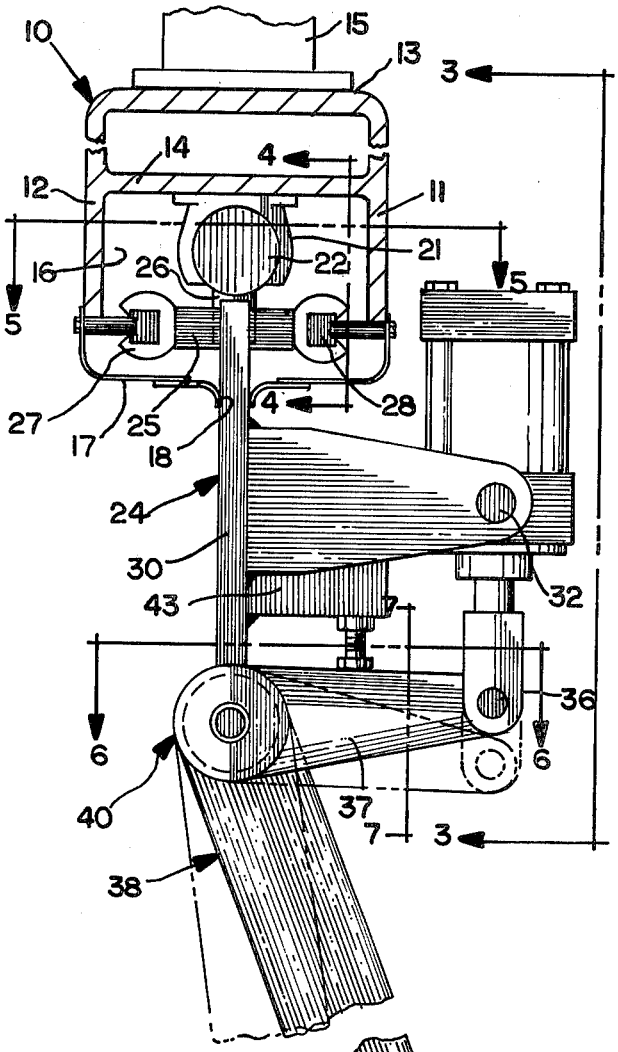
FIG. 3 is a fragmentary elevational view looking in the direction of arrows 3—3, FIG. 2.
Figure 3:
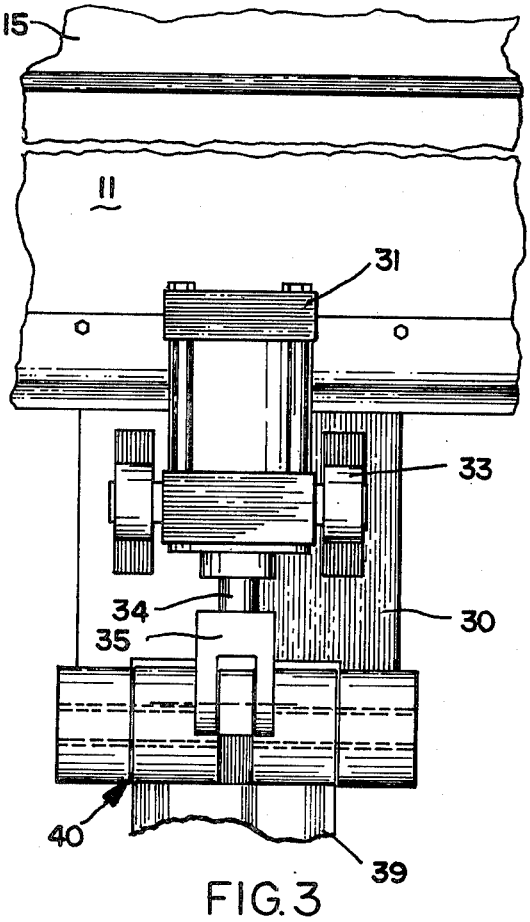

A vertical plate 30 is mounted on horizontal plate 25 and projects downwardly from chamber 16 through slot 18 of cover 17. A pneumatically actuated cylinder 31 is pivotally mounted by a pin 32 on a pair of spaced brackets 33 which are attached to vertical plate 30 and project horizontally outwardly therefrom as shown in FIGS. 2 and 3. A piston rod 34 has a clevis 35 mounted on its outer end which is pivotally attached by a pin 36 to the outer end of a lever arm 37 of a bellcrank, indicated generally at 38.

Bellcrank 38 includes a second, preferably longer lever arm 39 which is rigidly connected to lever arm 37. Bellcrank 38 is pivotally mounted by a bearing assembly 40 on the bottom of vertical plate 30. An adjustable stop bolt 42 is mounted on the bottom of a plate 43 which is attached to vertical plate 30. Bolt 42 is adapted to engage lever arm 37 to limit the upward-swinging pivotal movement thereof as can be seen in FIGS. 2 and 6.

In accordance with another feature of the invention, a cleaning brush assembly indicated generally at 45, is mounted on the swinging end of bellcrank lever arm 39. Brush assembly 45 includes a generally rectangular-shaped housing 46 which forms an interior brush chamber 47. A plurality of power driven brushes, each of which is indicated generally at 50, are mounted in chamber 47 for cleaning nozzle lips 6 in a manner described more fully below. Preferably five brushes 50 are mounted within chamber 47 and are individually indicated as 50*a*, 50*b*, 50*c*, 50*d* and 50*e*.

Figure 8:
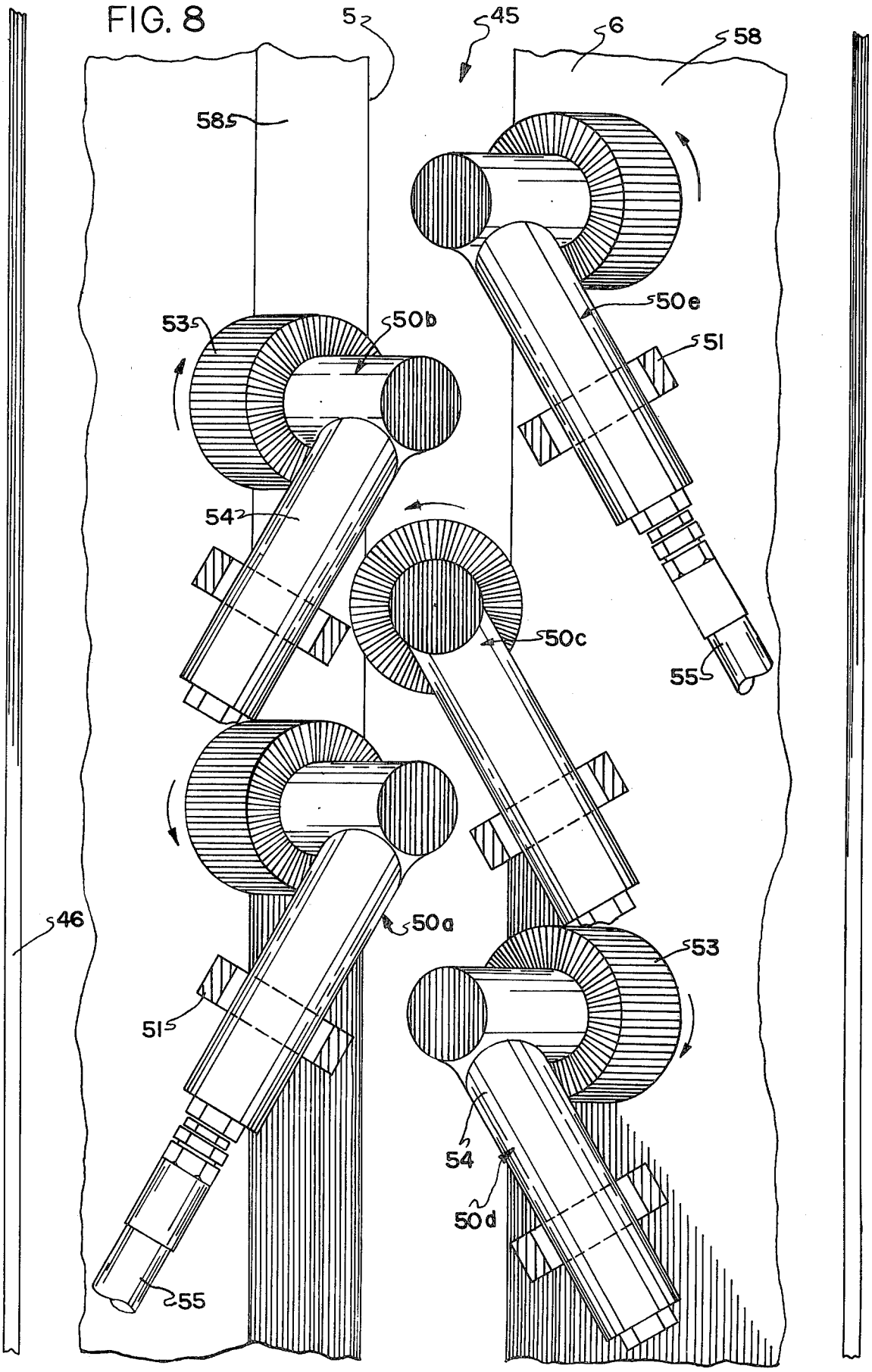
FIG. 8 is an enlarged fragmentary diagrammatic sectional view taken on line 8—8, FIG. 2.
Figure 9:
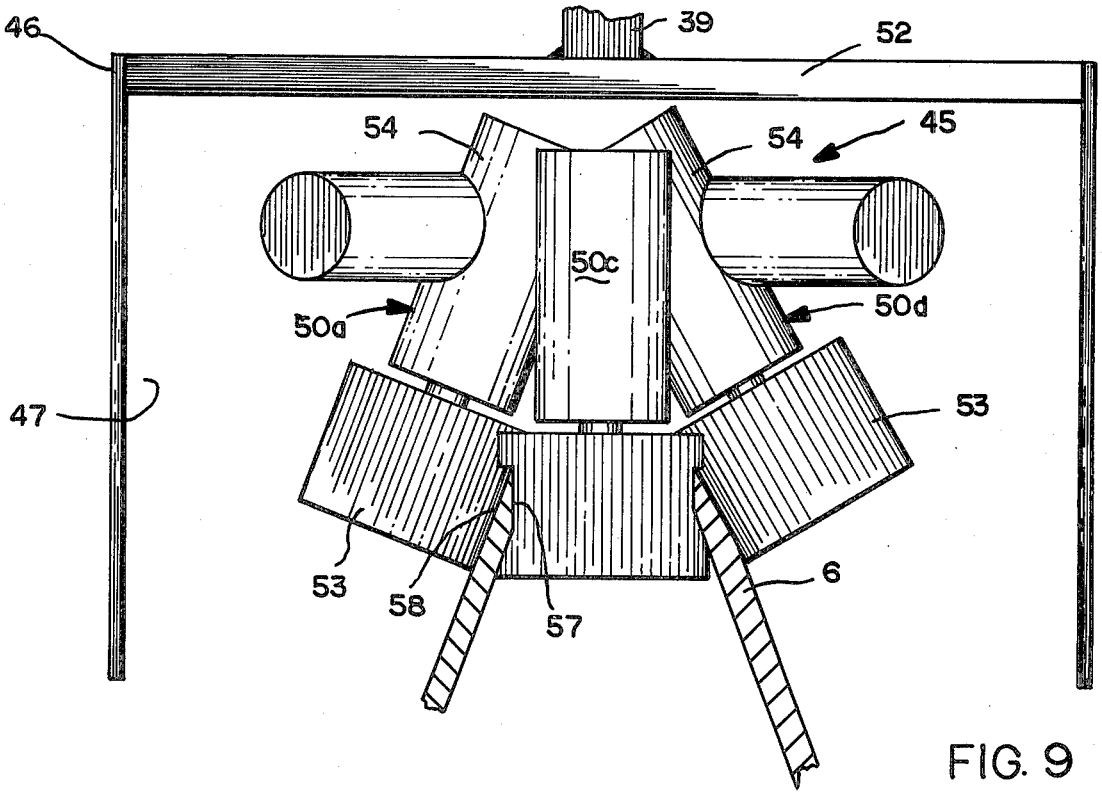
FIG. 9 is another fragmentary diagrammatic sectional view showing the cleaning brushes engaged with the nozzle lips.

Referring to FIGS. 8 and 9, each brush 50 is mounted in chamber 47 by a bracket 51 which is attached to one of the walls of housing 46. Each power driven brush 50 includes a cylindrical-shaped bristle brush 53 which is rotatably mounted on and driven by an air motor drive unit 54. An air line 55 is connected to each drive unit 54 and is adapted to be connected to a source of compressed air (not shown) for rotationally driving brush 53 in a conventional manner.

The operation of the improved cleaning mechanism is described below. An operator upon detecting that a streak is developing in moving substrate 4 will actuate an appropriate control system, which will pivot nozzle 2 from the full line position to the dot dash line position of FIG. 1. Carriage 24 then is moved transversely along frame 10 by actuation of rodless cylinder 20 until brush assembly 45 is positioned adjacent the particular area of nozzle discharge opening 5 which is causing the streak to develop on the substrate. Cylinder 31 then is actuated and will pivot bellcrank 38 in a counterclockwise direction (FIG. 2) moving brushes 50 into engagement with nozzle lips 6 as shown in FIG. 2.

Figure 10:
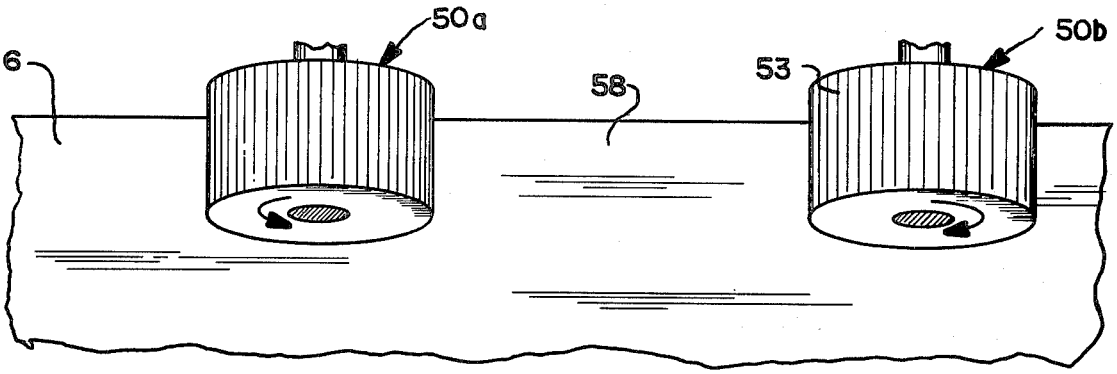
FIG. 10 is a fragmentary diagrammatic side elevational view showing one pair of the nozzle cleaning brushes engaged with the outer surface of the nozzle lips.

Brushes 50 are arranged so that brush **50*c* enters nozzle discharge opening 5 (FIG. 2) and engages the inside surfaces 57 of nozzle lips 6. Brush pairs 50*a* and 50*b* will engage outer surfaces 58 of one nozzle lip 6 and brushes 50*d* and 50*e* will engage outer surface 59 of the other nozzle lip 6 (FIGS. 9 and 10). The pivotal swinging movement of bellcrank 38 is controlled by stop bolt 42 which is adjusted so that lever arm 39 will swing to a predetermined position to properly engage brushes 50 with nozzle lips 6. The particular mounting mechanism for nozzle 2** is adjusted so that the nozzle will always be moved to a predetermined position for cleaning.

As soon as brushes 50 are engaged with the nozzle lips or simultaneously therewith, rodless cylinder 20 is actuated and will move carriage 24 together with bellcrank 38 and brushes 50, transversely along the nozzle lips to clean the lips. The operator by actuating appropriate pneumatic controls can move carriage 24 and brushes 50 in a back and forth motion along a predetermined length of nozzle opening 5 until he believes or can visually see that the dirt and debris has been adequately cleaned from the lips. The operator then will actuate cylinder 31 pivoting bellcrank 38 in a clockwise direction to retract brushes 50 from engagement with the nozzle lips. Nozzle 2 then is pivoted to the full line coating control position of FIG. 2 adjacent moving substrate 4.

The individual brushes of brush pairs **50*a*–50*b* and 50*d*–50*e* will rotate in opposite directions with respect to each other as shown by the rotational indicating arrows in FIG. 8**. This will balance the forces created by the rotating brushes so they will move easily in both directions.

The particular pneumatic controls for moving carriage 24, for actuating cylinder 31, and for driving air brush motors 54 are well known in the art and therefore they are not described in detail or shown in the drawings. Likewise, although a pneumatic power source is preferred, it could be hydraulic, electrical or any combination thereof without affecting the concept of the invention. For example, rodless cylinder 20 could be replaced with a cable cylinder, an electric-drive motor, a rack and pinion arrangement, a screw with traversing nut or similar mechanism for moving carriage 24 transversely along supporting frame 10.

Also, other types of mechanisms and arrangements may be provided for moving brushes 50 into and out of cleaning engagement with the nozzle lips. For example, nozzle 2 could be moved to a position intermediate the full line and dot dash lines of FIG. 2 wherein the nozzle is extending vertically upwardly and the cleaning mechanism is located directly above nozzle opening 5. A mechanism then can be provided for vertically raising and lowering the cleaning brushes, which may be rigidly mounted on the bottom of carriage 24, into and out of engagement with the nozzle lips instead of mounting the brushes on bellcrank 38. After the brushes are moved vertically downwardly into engagement with the nozzle lips, the carriage then is moved transversely along the nozzle opening for cleaning the nozzle lips in one particular area or transversely throughout the entire length thereof in the same manner as that described above for the particular arrangement shown in the drawings.

Another feature which may be incorporated into improved cleaning mechanism 1 is that the carriage when at rest, will be located adjacent one end of the nozzle and immediately upon the nozzle being moved to a cleaning position will automatically move transversely throughout the entire length of the nozzle opening and beyond to completely clean the entire nozzle lips instead of a particular problem area thereof. Also, the controls can be regulated so that the carriage will automatically return along the nozzle opening to its at rest position providing a forward and reverse cleaning action on the entire nozzle opening.

Furthermore, it is readily understood to anyone skilled in the art that brushes 50 may have other cleaning arrangements than that shown in the drawings and described above and still provide efficient cleaning for the nozzle lips. Also, nozzle 2 need not be an opening-style nozzle but can have a predetermined fixed nozzle discharge opening size with the brushes being sized to correspond to the nozzle opening and still provide an efficient cleaning mechanism therefor.

Figure 11:
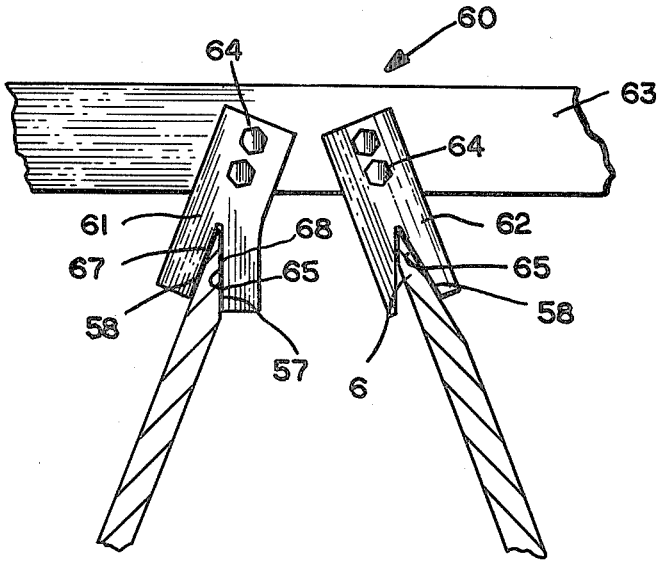
FIG. 11 is a fragmentary view showing scraper blades engaged with the nozzle lips.

Another type of cleaning device is shown in FIG. 11 and is indicated generally at 60. Device 60 includes a pair of scraper blades 61 and 62 which are attached to the ends of a mounting bar 63 by bolts 64 or other fastening means. Bar 63 is mounted on the swinging end of bellcrank lever 39 and is movable into and out of engagement with the nozzle lips in a similar manner as are brushes 50.

Blades 61 and 62 preferably are formed of blocks of a hard, low friction plastic material which will slide easily along the nozzle lips to remove the dirt particles therefrom without scratching the lip surfaces. Likewise, the blades could be formed of metal having a surface coating of a low friction material, such as Teflon, applied thereto.

Blades 61 and 62 are generally similar to each other with each block being formed with a V-shaped notch 65 defined by sloped side surfaces 66 and 67 which slidably engage inside and outside surfaces 57 and 58, respectively, of each nozzle lip 6.

If desired, only blades 61 and 62 can be used for cleaning nozzle lips 6 or they can be mounted adjacent brushes 50 and used in combination therewith to provide an additional type of cleaning arrangement.

Accordingly, the improved nozzle cleaning mechanism is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved cleaning mechanism for coating control fluid nozzle is constructed and used, the characteristics of the construction, and the advantageous, new and useful results obtained; the new and useful structures, devices, elements, arrangements, parts, and combinations, are set forth in the appended claims.

We claim:

1. A combination fluid nozzle and cleaning mechanism therefore including:

(a) a gaseous fluid nozzle for metering a thin film of liquid being applied to a moving substrate, said nozzle having a pair of elongated spaced lips defining a nozzle discharge opening;

(b) means for moving at least one of the nozzle lips between a working position adjacent the substrate and a cleaning position;

(c) cleaning means engageable with the nozzle lips for cleaning said lips;

(d) means for moving the cleaning means into and out of engagement with the nozzle lips;

(e) carriage means for supporting the cleaning means;

(f) frame means located adjacent the nozzle for supporting the carriage means; and (g) drive means for moving the carriage means along the frame means and the supported cleaning means across the length of the elongated nozzle lips.

2. The combination defined in claim 1 in which the cleaning means is a plurality of brushes.

3. The cleaning mechanism defined in claim 2 in which the cleaning brushes are rotatably mounted and are rotated by power drive means.

4. The cleaning mechanism defined in claim 3 in which the brush power drive means is a plurality of air driven motors.

5. The cleaning mechanism defined in claim 3 in which one of said brushes is adapted to extend into the nozzle discharge opening and clean inner surfaces of the nozzle lips; and in which other of said brushes are adapted to engage outer surfaces of the nozzle lips.

6. The cleaning mechanism defined in claim 5 in which the said other brushes include two pairs of brushes, each pair being engaged with an outer surface of the nozzle lips; and in which the individual brushes of each pair are rotated in opposite directions with respect to each other by the brush power drive means.

7. The cleaning mechanism defined in claim 1 in which the carriage drive means includes a rodless linear drive cylinder mounted on the frame and operatively connected to the carriage means.

8. The cleaning mechanism defined in claim 1 in which the frame includes a pair of spaced slide rails; and in which the carriage means includes a pair of slide bushings operatively engaged with said slide rails for movably mounting the carriage means on said frame.

9. The cleaning mechanism defined in claim 1 in which the means for moving the cleaning means into and out of engagement with the nozzle lips includes a pivotally mounted lever; in which the cleaning means is mounted on one end of the lever; and in which control means is operatively engaged with the lever for pivotally moving the lever to move the cleaning means with respect to the nozzle lips.

10. The cleaning mechanism defined in claim 9 in which the lever is a bellcrank; in which the cleaning means is mounted on one end of the bellcrank; and in which the control means is a fluid actuated cylinder which is engaged with the other end of the bellcrank.

11. The cleaning mechanism defined in claim 9 in which stop means is operatively engageable with the lever means to position the cleaning means with respect to the nozzle lips.

12. The cleaning mechanism defined in claim 1 in which the cleaning means are scraper blades.

13. The cleaning mechanism defined in claim 12 in which the scraper blades are formed of a plastic material.

14. The cleaning mechanism defined in claim 12 in which each of the scraper blades has a friction reducing surface portion which is adapted to engage the nozzle lips.

* * * * *

UNITED STATES PATENT AND TRADEMARK OFFICE

CERTIFICATE OF CORRECTION

PATENT NO. : 4,469,043

DATED : September 4, 1984

INVENTOR(S) : Herbert B, Kohler, et al

It is certified that error appears in the above-identified patent and that said Letters Patent are hereby corrected as shown below:

Claims 3 through 14, line 1, kindly change the words "cleaning mechanism" to --combination--.

Signed and Sealed this

*Twelfth* Day of *February 1985*

[SEAL]

*Attest:*

DONALD J. QUIGG

*Attesting Officer*

*Acting Commissioner of Patents and Trademarks*